US006710691B2

(12) United States Patent
Yu et al.

(10) Patent No.: US 6,710,691 B2
(45) Date of Patent: Mar. 23, 2004

(54) TRANSFORMER WITH AN ASSOCIATED HEAT-DISSIPATING PLASTIC ELEMENT

(75) Inventors: Wen-Lung Yu, Taoyuan Hsien (TW); Yin-Yuan Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/246,832

(22) Filed: Sep. 18, 2002

(65) Prior Publication Data

US 2004/0032312 A1 Feb. 19, 2004

(30) Foreign Application Priority Data

Aug. 14, 2002 (TW) ..... 91212596 U

(51) Int. Cl.[7] ..... H01F 27/08

(52) U.S. Cl. ..... 336/55; 336/60; 336/61; 336/90; 336/96

(58) Field of Search ..... 336/60, 61, 90, 336/96, 178, 180, 83, 55; 29/605

(56) References Cited

U.S. PATENT DOCUMENTS 4,843,362 A * 6/1989 Heritier-Best ..... 336/61
4,866,409 A * 9/1989 Umezaki ..... 336/96
5,210,513 A * 5/1993 Khan et al. ..... 336/61
5,469,124 A * 11/1995 O'Donnell et al. ..... 336/61
5,656,984 A * 8/1997 Paradis et al. ..... 336/61
6,002,318 A * 12/1999 Werner et al. ..... 336/61
6,563,410 B1 * 5/2003 Marton ..... 336/55

* cited by examiner

*Primary Examiner*—Anh Mai
(74) *Attorney, Agent, or Firm*—Charles C.H. Wu; Wu & Cheung, LLP

(57) ABSTRACT

A transformer with an associated heat-dissipating plastic element is provided. The transformer includes a hollow main body, a core, a coil and a heat-dissipating plastic element. The core is installed inside the hollow main body while the coil wraps around the core. The heat-dissipating plastic element is also installed inside the hollow main body. The heat-dissipating plastic element encloses the core and the coil. Alternatively, the heat-dissipating plastic element encloses the hollow main body, the core and the coil so that heat generated by the coil may be directly conducted away to the exterior through the heat-dissipating plastic element.

15 Claims, 3 Drawing Sheets

TRANSFORMER WITH AN ASSOCIATED HEAT-DISSIPATING PLASTIC ELEMENT

CROSS-REFERENCE TO RELATED APPLICATION

This application claims the priority benefit of Taiwan application serial no. 91212596, filed Aug. 14, 2002.

BACKGROUND OF THE INVENTION

1. Field of Invention

The present invention relates to a transformer. More particularly, the present invention relates to a transformer with an associated heat-dissipating plastic element.

2. Description of Related Art

Following the rapid progress in information technologies, various types of communication products and server structures with multiple functions are developed. Using the ever more popular mobile phone as an example, the transmission/reception of a mobile phone depends on a base station. In general, the base station is located at the top of a high-rise building and hence the broadcasting equipment in a base station is normally housed inside a wafer-proofed casing. In fact, the interior of a wafer-proofed casing can be regarded as a sealed space with little air current flowing inside. Obviously, the heat produced by various devices (all heat producing sources) inside the base station equipment is difficult to get out from the interior by air because air is a poor conductor of heat. Consequently, the best method of dissipating the heat generated by various devices inside the casing of a base station to the outside world is an important issue.

FIG. 1 is a perspective view of a conventional transformer structure. As shown in FIG. 1, a conventional transformer 100 includes a hollow main body 102, a core 104 and a coil 106. The core 104 is installed in the middle of the hollow main body 102 while the coil 106 wraps around the core 104.

FIG. 2 is a cross-sectional view of a conventional transformer and the sealed space within the transformer. As shown in FIG. 2, a conventional transformer 100 normally mounts on top of a circuit board 108. The circuit board 108 has an open cavity 110 for accommodating a first thermal pad 112. In general, a second thermal pad 114 is also attached to the upper surface of the hollow main body 102. Using a base station as an example, the transformer 100 is housed inside the sealed space of a casing 116. The transformer 100 contacts the casing 116 through the first thermal pad 112 and the second thermal pad 114 to facilitate heat dissipation.

The main source of heat comes from the coil 106 inside the transformer 100. Because convection circulation inside the sealed interior of the casing 116 is very poor, heat produced by the coil 106 can hardly be channeled away to the exterior. In other words, the heat generated by the coil 106 of the transformer 100 is mainly carried away through the contact with the core 104. Through the core 104, heat is conducted away via the hollow main body 102, the first thermal pad 112 and the second thermal pad 114 to the casing 116.

In a conventional transformer, contact area between the coil and the core is very limited. Hence, very little heat generated by the coil can be conducted to the core via the contact area for thermal dissipation. It is inevitable that a gap is existing between the coil and the core when copper wires are wrapped around the core to produce the coil, contact area between the coil and the core is diminished even further.

Ultimately, the capacity for dissipating heat away from the transformer coil would further get worse for the transformer in a limited space.

Therefore, subject to the effect caused by the very limited contact area between the coil and the core, the coil may be overheated when the transformer is in operation. The low efficiency of thermal dissipation causes an accumulation of thermal into high temperature. This will also directly affect the lifetime and the performance for the transformer and its peripheral electronic devices.

SUMMARY OF THE INVENTION

Accordingly, one object of the present invention is to provide a transformer with an associated heat-dissipating plastic element therein capable of dissipating heat away from a transformer coil faster.

To achieve these and other advantages and in accordance with the purpose of the invention, as embodied and broadly described herein, the invention provides a transformer with an associated heat-dissipating plastic element. The transformer includes a hollow main body, a core, a coil and a heat-dissipating plastic element. The core is installed inside the hollow main body while the coil wraps around the core. The heat-dissipating plastic element is also installed inside the hollow main body but encloses the core and the coil. In addition, the heat-dissipating plastic element has a heat transfer coefficient higher than air.

In this invention, the hollow main body and the core inside the transformer are formed as an integrative unit made from a material such as ferrous ceramics. In addition, the coil is coated with a layer of lacquer.

In this invention, the transformer may be mounted on a printed circuit board. The circuit board has an open cavity for installing a first thermal pad. The first thermal pad serves to conduct heat away from the hollow main body to the casing. To increase the heat-dissipating capacity of the transformer, a second thermal pad may be installed above the hollow main body for conducting heat away from the hollow main body to the casing via the second thermal pad.

In another embodiment of this invention, the heat-dissipating plastic element occupies the hollow main body and encloses the core and the coil entirely so that the plastic element is able to conduct heat directly from the first thermal pad and the second thermal pad to the casing. In this embodiment, the heat transfer coefficient of the heat-dissipating plastic is higher than the hollow main body.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 2:
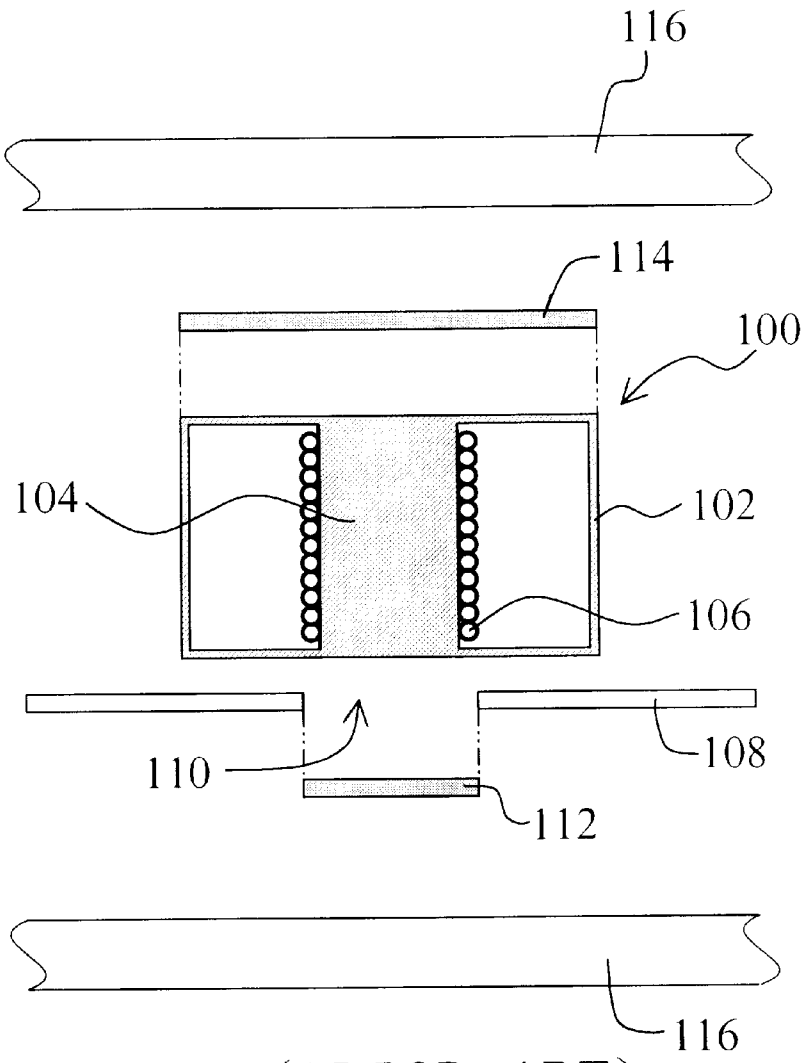
FIG. 2(PRIOR ART)
FIG. 2 is a cross-sectional view of a conventional transformer and the sealed pace within the transformer.
Figure 1:
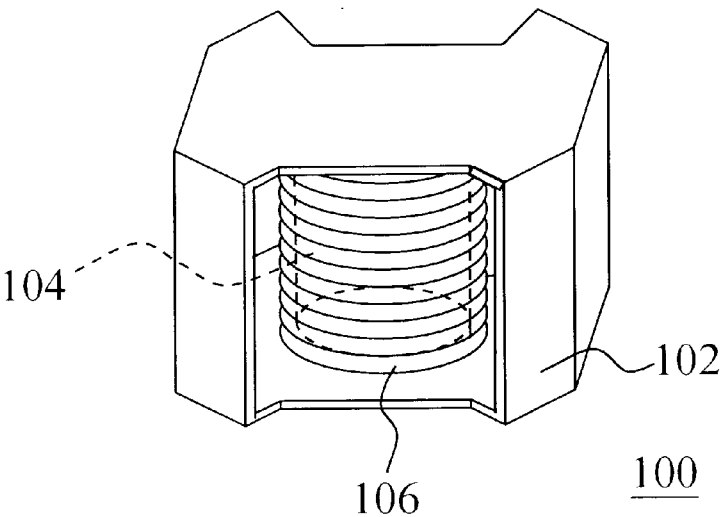
FIG. 1 (PRIOR ART)
FIG. 1 is a perspective view of a conventional transformer structure.

Reference will now be made in detail to the present preferred embodiments of the invention, examples of which are illustrated in the accompanying drawings. Wherever possible, the same reference numbers are used in the drawings and the description to refer to the same or like parts.

Figure 3:
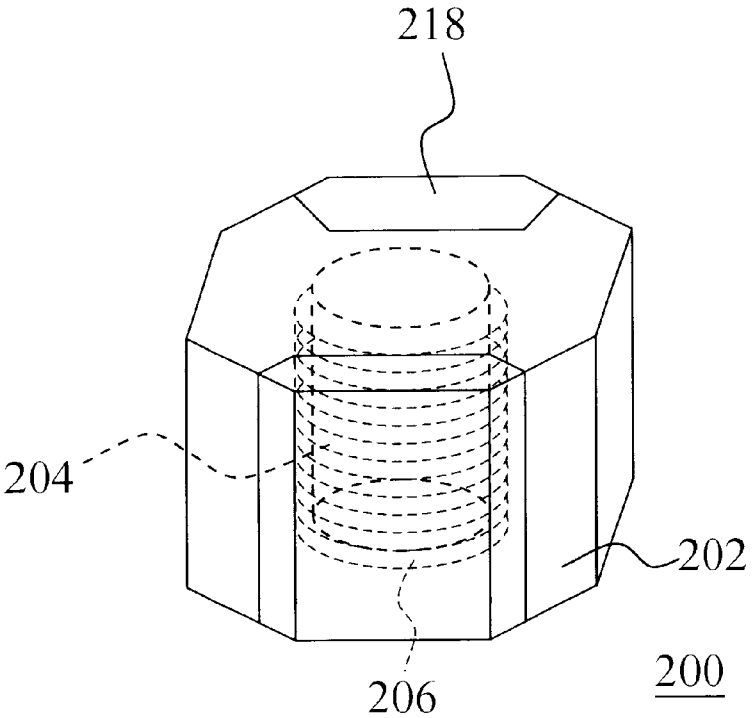
FIG. 3 is a perspective view of a transformer having a heat-dissipating plastic element according to a first embodiment of this invention.

FIG. 3 is a perspective view of a transformer having a heat-dissipating plastic element according to a first embodiment of this invention. As shown in FIG. 3, the transformer 200 mainly includes a hollow main body 202, a core 204, an electric coil 206 and a block of heat-dissipating plastic 218. The core 204 is installed inside the hollow main body 202 while the electric coil 206 wraps around the core 204. The heat-dissipating plastic element 218 occupies the interior of the hollow main body 202 and encloses the core 204 and the electric coil 206. In this embodiment, the hollow main body 202 and the core 204 are formed as an integrative unit using a material such as ferrous ceramics and the electric coil 206 is made from lacquer coated wires. Furthermore, the heat-dissipating plastic 218 has a heat transfer coefficient greater than air.

Figure 4:
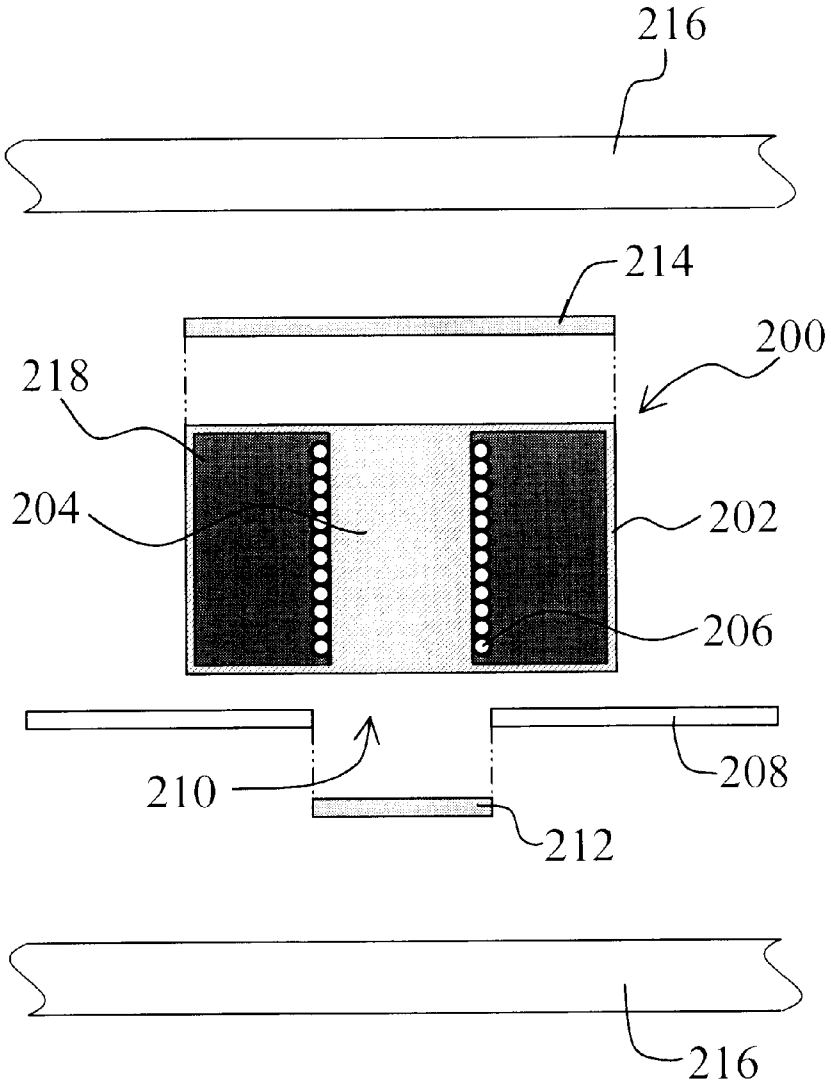
FIG. 4 is a cross-sectional view of a transformer having a heat-dissipating plastic element inside the sealed space of the transformer according to the first embodiment of this invention.

FIG. 4 is a cross-sectional view of a transformer having a heat-dissipating plastic element inside the sealed space of the transformer according to the first embodiment of this invention. As shown in FIG. 4, the transformer 200 is mounted on a circuit board 208. The circuit board 208 has an open cavity 210. The open cavity 210 is able to accommodate a first thermal pad 212. In addition, a second thermal pad 214 is also attached to the roof of the transformer 200 or the upper surface of the hollow main body 202. Using a base station as an example, the transformer 200 is set up inside the sealed space of a casing 216. The transformer 200 is in contact with the casing 216 through the first thermal pad 212 and the second thermal pad 214. Hence, heat is transferred to the casing 216 and channeled away from the transformer 200.

The electric coil 206 inside the transformer 200 is the main source of heat. Since convection current inside the sealed space of the transformer 200 is minimal, the electric coil 206 can hardly transfer any heat away from the interior of the casing to the exterior by air. The heat generated by the coil 206 can be channeled away via two major routes. In the first route, the heat can be conducted away from the coil 206 to the core 204 through contact with the core 204. Thereafter the heat is conducted away from the core 204 to the hollow main body 202. In the second route, the heat generated by the coil 206 is passed to the core 204 and the hollow main body 202 via the heat-dissipating plastic element 218. After transferring to the core 204 and the hollow main body 202, the heat is transferred to the casing 216 through the first thermal pad 212 and the second thermal pad 214.

In this embodiment, the heat transfer coefficient of the heat-dissipating plastic element 218 is much greater than air. Hence, the heat-dissipating plastic element 218 is very effective in transferring heat away to the core 204 and the hollow main body 202. In other words, by using a block of heat-dissipating plastic 218 with a high heat transfer coefficient, the problem of cooling a sealed interior space with a heat-producing source is effectively solved.

Figure 5:
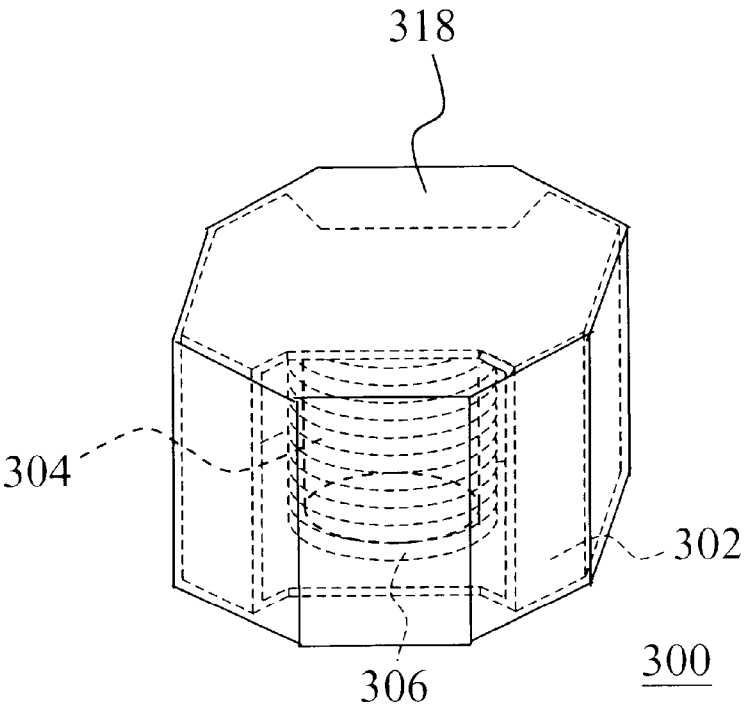
FIG. 5 is a perspective view of a transformer having a heat-dissipating plastic element according to a second embodiment of this invention.

FIG. 5 is a perspective view of a transformer having a heat-dissipating plastic element according to a second embodiment of this invention. As shown in FIG. 5, the transformer 300 includes a hollow main body 302, a core 304, an electric coil 306 and a heat-dissipating plastic element 318. The core 304 is installed inside the hollow main body 302 while the coil 306 wraps around the core 304. The heat-dissipating plastic element 318 encloses the entire hollow main body 302 including the core 304 and the coil 306 so that heat can be directly conducted to the exterior. In addition, the hollow main body 302 and the core 304 may be manufactured as an integrative unit using a material such as ferrous ceramics and the electric coil 306 is made from lacquer coated wires. Furthermore, the heat-dissipating plastic 318 has a heat transfer coefficient greater than the hollow main body 302. This embodiment is very similar to the first embodiment except the extent of distribution of the heat-dissipating plastic element 318.

Figure 6:
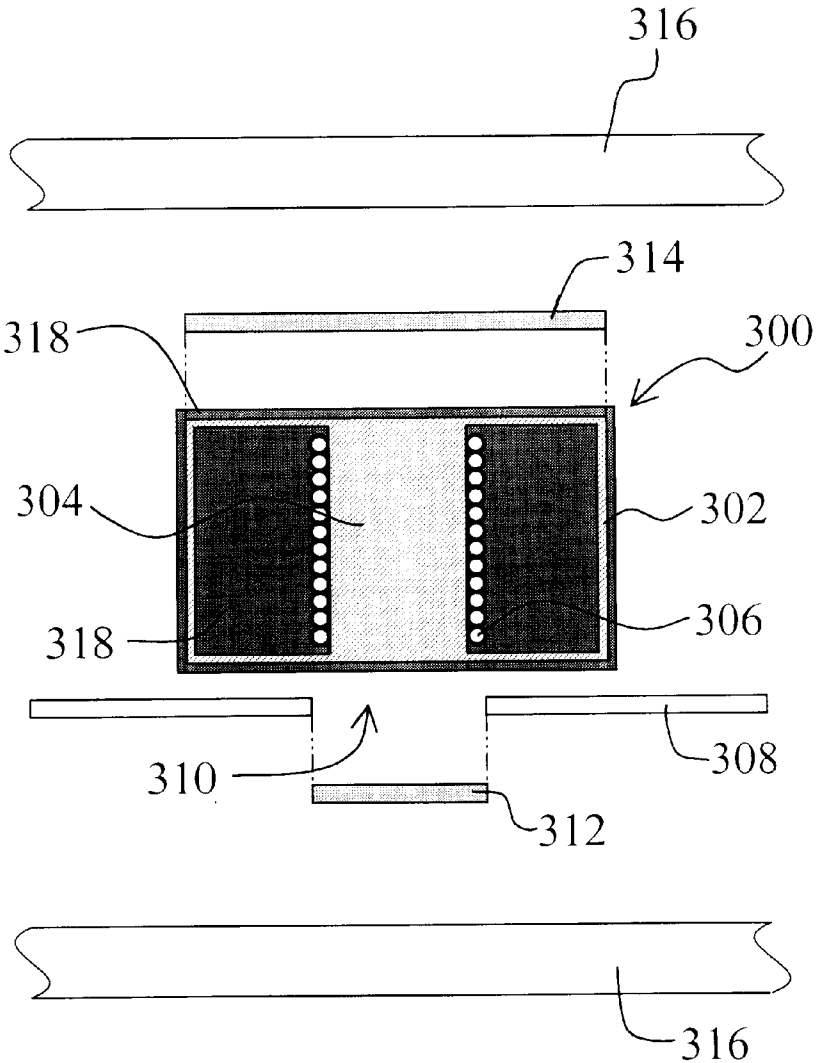
FIG. 6 is a cross-sectional view of a transformer having a heat-dissipating plastic element inside the sealed space of the transformer according to the second embodiment of this invention.

FIG. 6 is a cross-sectional view of a transformer having a heat-dissipating plastic element inside the sealed space of the transformer according to the second embodiment of this invention. As shown in FIG. 6, the transformer 300 mounts on a circuit board 308. The circuit board 308 has an open cavity 310. The open cavity 310 is able to accommodate a first thermal pad 312. In addition, a second thermal pad 314 is also attached to the roof of the transformer 300 or the upper surface of the hollow main body 302. Using a base station as an example, the transformer 300 is set up inside the sealed space of a casing 316. The transformer 300 is in contact with the casing 316 through the first thermal pad 312 and the second thermal pad 314. Hence, heat is transferred to the casing 316 and channeled away from the transformer 300.

The electric coil 306 inside the transformer 300 is the main source of heat. The heat generated by the coil 306 can be channeled away via three major routes. In the first route, the heat can be conducted away from the coil 306 to the core 304 through contact with the core 304. Thereafter the heat is conducted away from the core 304 to the hollow main body 302 and then to the heat-dissipating plastic element 318. In the second route, the heat generated by the coil 306 is passed to the core 304 and the hollow main body 302 via the heat-dissipating plastic element 318. Thereafter, the heat is transferred to the heat-dissipating plastic element 318 outside the hollow main body 302. In the third route, the heat generated by the coil 306 is transferred directly from the interior of the hollow main body 302 to the exterior of the hollow main body 302 through the heat-dissipating plastic element 318. After transferring to the heat-dissipating plastic element 318 via the hollow main body 302, the heat is conducted away to the casing 316 via the first thermal pad 312 and the second thermal pad 314, thereby cooling the transformer 300.

In this embodiment, the heat transfer coefficient of the heat-dissipating plastic element 318 is much greater than the hollow main body 302. Hence, the heat-dissipating plastic element 318 is very effective in transferring heat away from the coil 306. In a similar way, this embodiment resolves the problem of cooling a sealed interior space (without any convection current therein) with a heat-producing source is effectively solved.

In summary, the advantages of having a heat-dissipating plastic element inside the transformer include:

1. Using a heat-dissipating plastic with a thermal transfer coefficient greater than air, heat produced by the coil is rapidly channeled away to the hollow main body. Hence, the low heat-dissipating capacity in a conventional transformer due to a small contact area between the coil and the core is boosted.
2. This invention also uses a heat-dissipating plastic element with a thermal transfer coefficient higher than the hollow main body so that heat may pass directly from the transformer to the casing without going through any intervening thermal pads. This arrangement not only reduces production cost, but also has a positive effect on the cooling of the transformer.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A transformer having an associated heat-dissipating plastic element for mounting on a printed circuit board inside a casing, the transformer comprising:

a hollow main body;

a core installed inside the hollow main body;

an electric coil wrapped around the core; and a heat-dissipating plastic element inside the hollow main body enclosing the core and the coil, wherein the heat-dissipating plastic element has a thermal transfer coefficient greater than air.

2. The transformer of claim 1, wherein the hollow main body and the core are manufactured together as an integrative unit.

3. The transformer of claim 1, wherein material constituting the hollow main body and the core includes ferrous ceramics.

4. The transformer of claim 1, wherein the coil is made using a lacquer coated wire.

5. The transformer of claim 1, wherein the circuit board has an open cavity.

6. The transformer of claim 5, wherein the transformer further includes a first thermal pad inside the open cavity for conducting heat from the hollow main body to the casing.

7. The transformer of claim 1, wherein the transformer further includes a second thermal pad on top of the hollow main body for conducting heat from the hollow main body to the casing.

8. A transformer having an associated heat-dissipating plastic element for mounting on a printed circuit board inside a casing, the transformer comprising:

a hollow main body;

a core installed inside the hollow main body;

an electric coil wrapped around the core; and a heat-dissipating plastic element enclosing the hollow main body, the core and the coil, wherein the heat-dissipating plastic element has a thermal transfer coefficient greater than air.

9. The transformer of claim 8, wherein the hollow main body and the core are manufactured together as an integrative unit.

10. The transformer of claim 8, wherein material constituting the hollow main body and the core includes ferrous ceramics.

11. The transformer of claim 8, wherein the coil is made using a lacquer coated wire.

12. The transformer of claim 8, wherein the circuit board has an open cavity.

13. The transformer of claim 12, wherein the transformer further includes a first thermal pad inside the open cavity for conducting heat from the heat-dissipating plastic element to the casing.

14. The transformer of claim 8, wherein the transformer further includes a second thermal pad on top of the hollow main body for conducting heat from the heat-dissipating plastic element to the casing.

15. The transformer of claim 8, wherein the heat-dissipating plastic element has a thermal transfer coefficient greater than the hollow main body.

* * * * *